US012774064B1

(12) United States Patent
Colegrove et al.

(10) Patent No.: US 12,774,064 B1
(45) Date of Patent: Oct. 27, 2026

(54) UNMANNED UNDERSEA VEHICLE SELF-POSITIONING APPARATUS AND METHODS

(71) Applicant: The United States of America, as represented by the Secretary of the Navy, Arlington, VA (US)

(72) Inventors: Dana Colegrove, Fairfax, VA (US); Peter Cho, Falls Church, VA (US); Richard Banko, Ashburn, VA (US); Hung Vo, Chantilly, VA (US); Jeeven Hugh, Germantown, MD (US)

(73) Assignee: The United States of America, represented by the Secretary of the Navy, Washington, DC (US)

( * ) Notice: Subject to any disclaimer, the term of this patent is extended or adjusted under 35 U.S.C. 154(b) by 293 days.

(21) Appl. No.: 18/401,786

(22) Filed: Jan. 2, 2024

Related U.S. Application Data

(60) Provisional application No. 63/482,164, filed on Jan. 30, 2023.

(51) Int. Cl.
*B63B 79/40* (2020.01)
*B63B 79/15* (2020.01)
*B63G 8/38* (2006.01)

(52) U.S. Cl.
CPC ..... *B63B 79/40* (2020.01); *B63B 79/15* (2020.01); *B63G 8/38* (2013.01)

(58) Field of Classification Search
CPC ..... B63B 79/40; B63B 79/15; B63B 8/38
See application file for complete search history.

(56) References Cited

U.S. PATENT DOCUMENTS 3,918,113 A * 11/1975 Talkington ..... B63B 22/18 114/245
4,010,619 A * 3/1977 Hightower ..... D07B 1/147 174/113 C
5,598,152 A * 1/1997 Scarzello ..... G01S 5/10 342/22
6,474,254 B1 * 11/2002 Ambs ..... G01V 1/3808 405/172

(Continued)

FOREIGN PATENT DOCUMENTS

CA 2897192 C * 7/2020 ..... G01V 1/18
CN 211741599 U 10/2020

(Continued)

*Primary Examiner* — Tyler J Lee
(74) *Attorney, Agent, or Firm* — Jesus J. Hernandez; U.S. Department of the Navy, Office of the General Counsel

(57) ABSTRACT

Example embodiments provide a sensing whisker apparatus and/or method. The sensing whisker apparatus may comprise at least one sensing unit that may generate an electromagnetic field and may sense alterations to the electromagnetic field. The apparatus and/or method may also include a nonferrous support providing a surface along at least an axis, which may be configured to support the at least one sensing unit. A sensor supply line may traverse the nonferrous support and be configured to provide electricity to each of the at least one sensing unit. An operational component may be configured to at least control the electricity provided through the sensor supply line and to receive sensed alterations to the electromagnetic field.

15 Claims, 11 Drawing Sheets

(56) References Cited

U.S. PATENT DOCUMENTS 6,693,560 B2 * 2/2004 Knust ..... B63G 8/38 114/340
7,017,911 B1 * 3/2006 Chia ..... A63H 23/08 273/447
7,578,038 B2 * 8/2009 McMillan ..... B63B 21/502 29/402.09
9,498,883 B2 * 11/2016 Jun ..... B25J 9/1602
9,625,597 B2 4/2017 Grimsdale
9,791,862 B1 10/2017 Connor
9,804,286 B2 * 10/2017 Sigona ..... G21C 7/08
10,725,191 B2 * 7/2020 Gudmundsson ..... G01V 3/081
11,061,160 B1 * 7/2021 Weber ..... F16L 1/12
11,692,868 B2 * 7/2023 Sewell ..... G01D 5/145 73/579
11,958,579 B2 * 4/2024 Englot ..... G01S 15/89
2006/0117848 A1 * 6/2006 Raffalt ..... G01F 23/0038 73/313
2008/0141921 A1 * 6/2008 Hinderks ..... F01L 3/22 114/274
2011/0234421 A1 * 9/2011 Smith ..... H01B 3/004 340/854.3
2013/0083622 A1 4/2013 Herrman
2015/0369584 A1 * 12/2015 Sigona ..... G21C 7/14 324/207.26
2015/0369632 A1 * 12/2015 Sigona ..... G01V 3/10 324/207.17
2015/0369943 A1 * 12/2015 Sigona ..... G01V 3/10 324/207.15
2016/0221441 A1 * 8/2016 Hall ..... H02J 50/005
2017/0074664 A1 * 3/2017 Cheramie ..... B63G 8/001
2018/0172867 A1 * 6/2018 Gudmundsson ..... G01V 3/104
2019/0346390 A1 11/2019 Lettow
2020/0393291 A1 * 12/2020 Sewell ..... G01P 5/04
2022/0260047 A1 * 8/2022 Weaver ..... G05D 1/048
2023/0219678 A1 * 7/2023 Rezac ..... B60P 3/1075 701/1
2024/0402376 A1 * 12/2024 Mattsson ..... G01V 3/165

FOREIGN PATENT DOCUMENTS

CN 109975810 B 12/2020
WO WO-2023003477 A1 * 1/2023 ..... G01N 1/08

* cited by examiner

UNMANNED UNDERSEA VEHICLE SELF-POSITIONING APPARATUS AND METHODS

CROSS-REFERENCE TO RELATED APPLICATIONS

This application claims the benefit of U.S. Provisional Application No. 63/482,164 filed Jan. 30, 2023, titled "Unmanned Undersea Vehicle Self-Positioning Apparatus and Methods," incorporated herein by reference.

STATEMENT OF GOVERNMENT INTEREST

The following description was made in the performance of official duties by employees of the Department of the Navy. The claimed subject matter, encompassing various example embodiments, may be manufactured, used, licensed by or for the United States Government for governmental purposes without the payment of any royalties thereon. Potential licensees may contact the Technology Transfer Office, NAVSEA Naval Surface Warfare Center, Carderock Division, 9500 MacArthur Blvd., West Bethesda, MD 20817, USA.

FIELD

The following description relates generally to sensing technologies.

BACKGROUND

Unmanned underwater vehicles may be required to perform an array of functions. These may include detecting, tracking, and locating electrically conductive and/or magnetically permeable metallic objects. Performing these functions in underwater environments may present difficulties for unmanned underwater vehicles. This difficulty may be compounded during a homing and/or docking activity.

According to the state of the art, two common approaches to searching and locating metallic objects in an underwater environment are sonar sensing and optical lights. Sonar sensing allows for detecting and locating objects through the use of sound waves. The sound wave may be projected and thereafter reflected by detected objects. This method is particularly prominent in underwater vehicles. However, sonar sensing systems have various shortcomings, such as limited energy management controllability and directional accuracy when searching for metallic objects.

The second conventional approach is optical lights. Optical lights may detect and locate many objects. However, optical lights may be hampered by a physical detection distance limitation. Also, optical lights may have operational limits based on underwater environmental conditions.

SUMMARY

Example embodiments provide a sensing whisker apparatus and/or method. The sensing whisker apparatus may comprise at least one sensing unit that may generate an electromagnetic field and may sense alterations to the electromagnetic field. The apparatus and/or method may also include a nonferrous support providing a surface along at least an axis, which may be configured to support the at least one sensing unit. A sensor supply line may traverse the nonferrous support and be configured to provide electricity to each of the at least one sensing unit. An operational component may be configured to at least control the electricity provided through the sensor supply line and to receive sensed alterations to the electromagnetic field.

BRIEF DESCRIPTION OF DRAWINGS

The accompanying figures are included to provide a further understanding of example embodiments, and are incorporated in and constitute part of this specification. In the figures.

DETAILED DESCRIPTION

In the following description, for purposes of explanation and not limitation, specific details are set forth such as particular structures, designs, techniques, etc., in order to provide a thorough understanding of the example embodiments. However, it will be apparent to those skilled in the art that the disclosed subject matter may be practiced in other illustrative embodiments that depart from these specific details. In some instances, detailed descriptions of well-known elements and/or method are omitted so as not to obscure the description with unnecessary detail. All principles, aspects, and embodiments, as well as specific examples thereof, are intended to encompass both structural and functional equivalents of the disclosed subject matter. Additionally, it is intended that such equivalents include both currently known equivalents as well as equivalents developed in the future.

The following description refers to an apparatus and method for using a combination of orthogonal electromagnetic transducer/sensor with Hall Effect circuits for unmanned undersea vehicle self-positioning mechanism against metallic objects. However, it should be noted that the example embodiments shown and described herein are meant to be illustrative only and not limiting in any way. As such, various modifications will be apparent to those skilled in the art for application to other fields based on technologies other than the above, which may be in various stages of development and intended for future replacement of, or use with, the above described method or apparatus.

The goal of example embodiments is to provide a simple, cost effective, highly accurate, and energy efficient method to search and locate certain types of objects in an underwater environment. The objects may be any kind of metallic, electrically conductive and/or magnetically permeable, object. The search and location operation may be undertaken through a combination of electromagnetic transducers/sensors and Hall Effect receivers. Example embodiments may use electronic circuits and a control algorithm for a self-positioning mechanism for an unmanned undersea vehicle for underwater maneuverings. Example embodiment may provide controllability of sensing intensity based on a metallic object location, as well as required accuracy, and energy management specifications.

Figure 1:
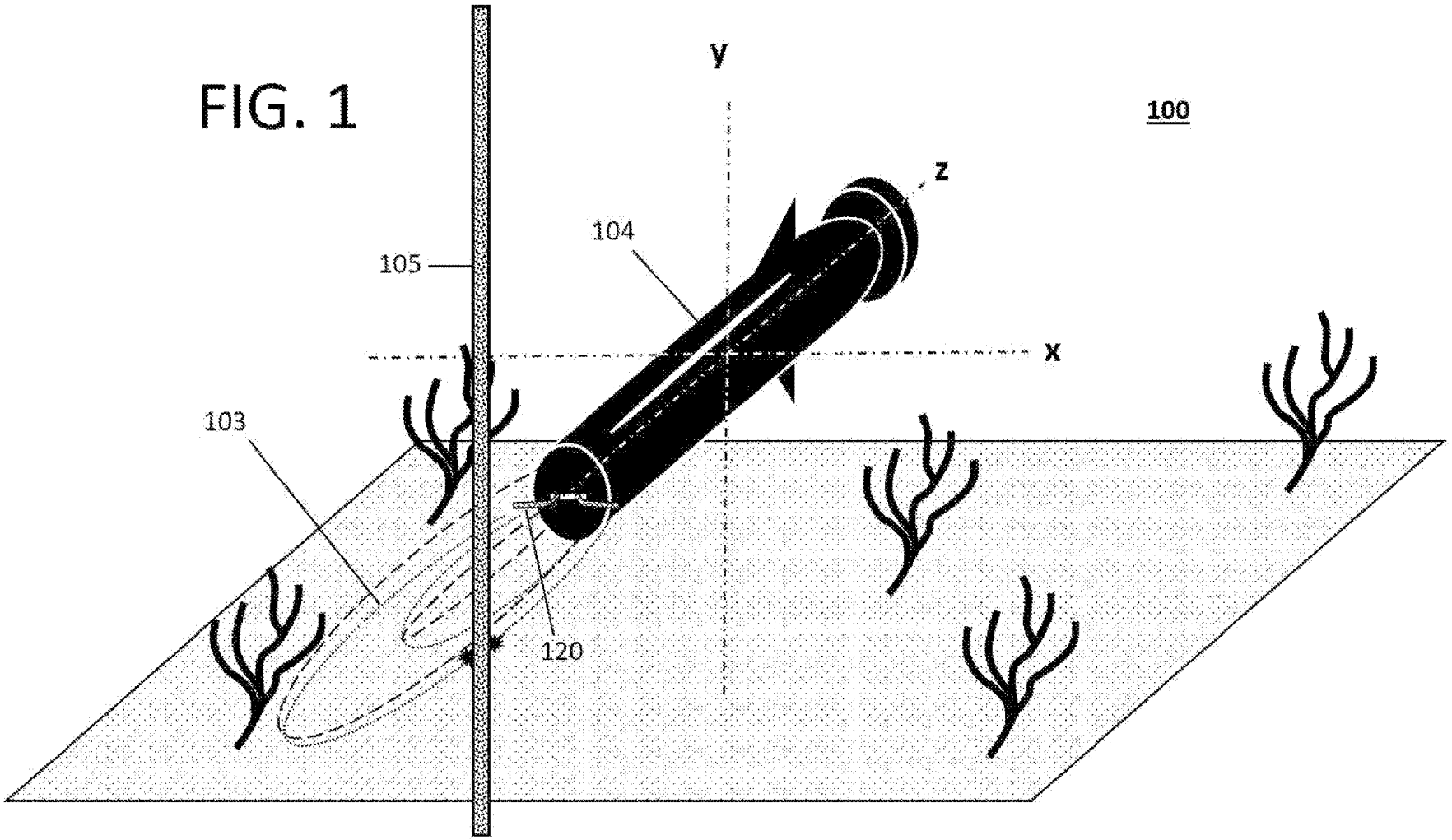
FIG. 1 is an operation of an unmanned undersea vehicle (UUV) with sensing whiskers according to example embodiments.

FIG. 1 is an operation 100 of an unmanned undersea vehicle (UUV) 104 with sensing whiskers according to example embodiments. As shown in FIG. 1, the UUV 104 may traverse an undersea environment. The undersea environment may be littoral, open-water, or deep-water. In this example embodiment, sensing whiskers configuration 120 may be positioned at the bow of the UUV 104. In alternative example embodiments, the sensing whiskers 120 may be positioned in other locations of the UUV 104.

The sensing whiskers 120 may generate an electromagnetic field. FIG. 1 depicts sensing electromagnetic flux lines 103 to illustrate the field that is generated. With respect to the sensing electromagnetic flux lines 103, there is an electric field component about the x-axis, and a counterpart magnetic component about the y-axis. This characteristic is discussed further below.

Each sensing whisker in the sensing whisker configuration 120 may each be designed to include a plurality of sensing units. The sensing whiskers configuration 120 may be powered by a supply within the UUV 104. In alternative example embodiments, the sensing whiskers configuration 120 may include their own power supply and/or capture energy through the kinetic motion of the UUV 104.

The sensing electromagnetic flux lines 103 may be used to detect any kind of metallic, electrically conductive and/or magnetically permeable object 105. The metallic object 105 may be a line from a surface ship or other form of marine vehicle. In operation 100, the sensing electromagnetic flux lines 103 are able to distinguish the presence of metallic object 105 from marine fauna, flora, and other non-metallic objects in the water, on the sea bed, on the surface, and/or anywhere else in the marine environment.

The metallic properties of the metallic object 105 may alter the electromagnetic field, as depicted by the sensing electromagnetic flux lines 103. Operational components in the UUV 104 may extrapolate the location and/or other characteristics of the metallic object 105 based on alterations in the electromagnetic field. The alterations in the electromagnetic field may be identified through a commensurate change in voltage in the sensing whiskers configuration 120.

In alternative example embodiments, the operational components may be at a remote location, such that the sensed data is transmitted to the remote location and the location and/or other characteristics of the metallic object 105 may be extrapolated from the remote location. The remote location may be another UUV, a manned underwater vehicle, a surface vehicle, a relay, and/or a receiving center (e.g., port, satellite/antenna). In yet other example embodiments, the UUV 104 may itself be in a manned undersea vehicle or a surface vehicle.

Figure 2:
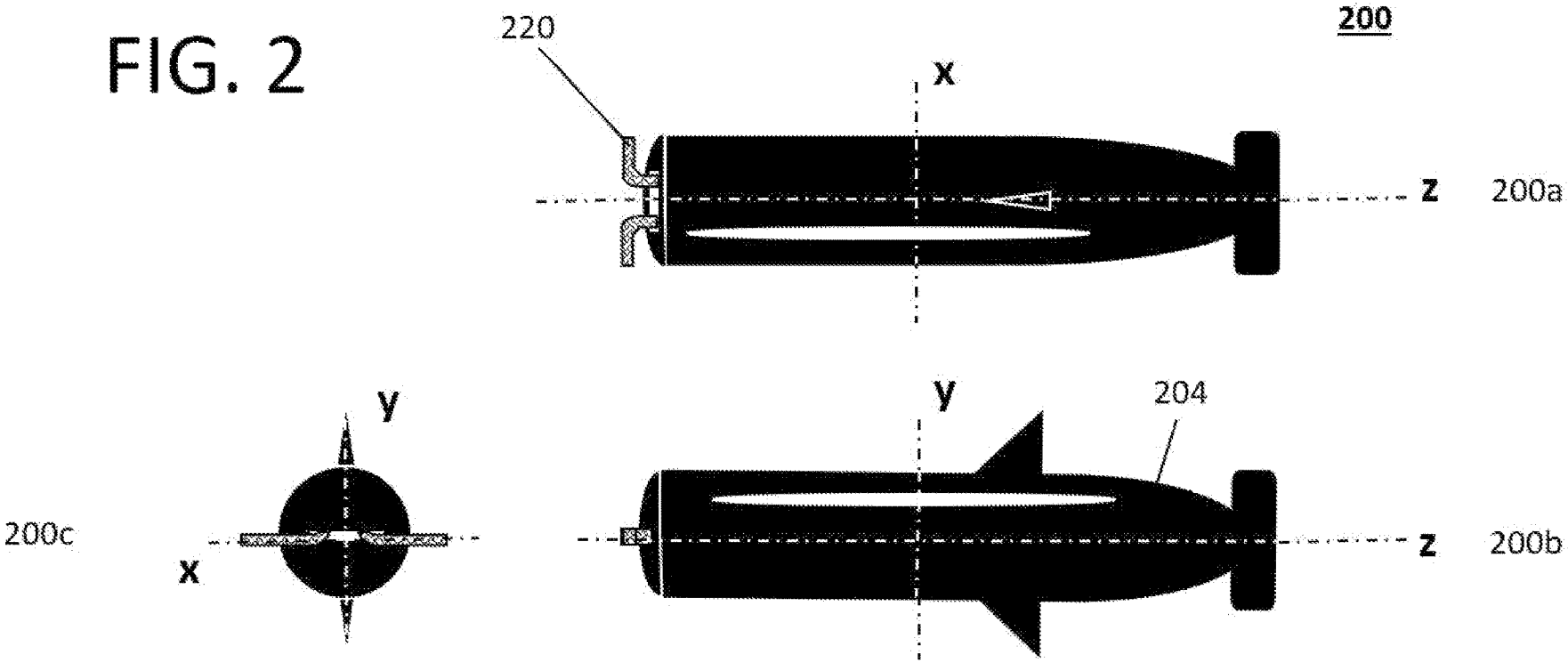
FIG. 2 is a multiple view illustration of a UUV with sensing whiskers according to example embodiments.

FIG. 2 is a multiple view illustration 200 of a UUV with sensing whiskers according to example embodiments. An x-z plane view 200*a* depicts a top view of a UUV 204. The sensing whiskers configuration 220 is shown as two individual whiskers protruding from a sensing whisker base and along the x-axis. The sensing whiskers configuration 220 may be housed within the sensing whisker base during non-use, and deployed if/when needed. The y-z plane view 200*b* illustrates a side view of the UUV 204. In this example embodiment, there are no additional sensing whiskers in the sensing whiskers configuration 220 about the y-axis. The y-x plane view 200*c* illustrates a front view of the UUV 204. In this example embodiment, the two whiskers in the sensing whiskers configuration 220 are separated by a length. In some example embodiment, the length provides an opening in the sensing whisker base for the purpose of permitting the UUV 204 to grab a metallic object.

Figure 3:
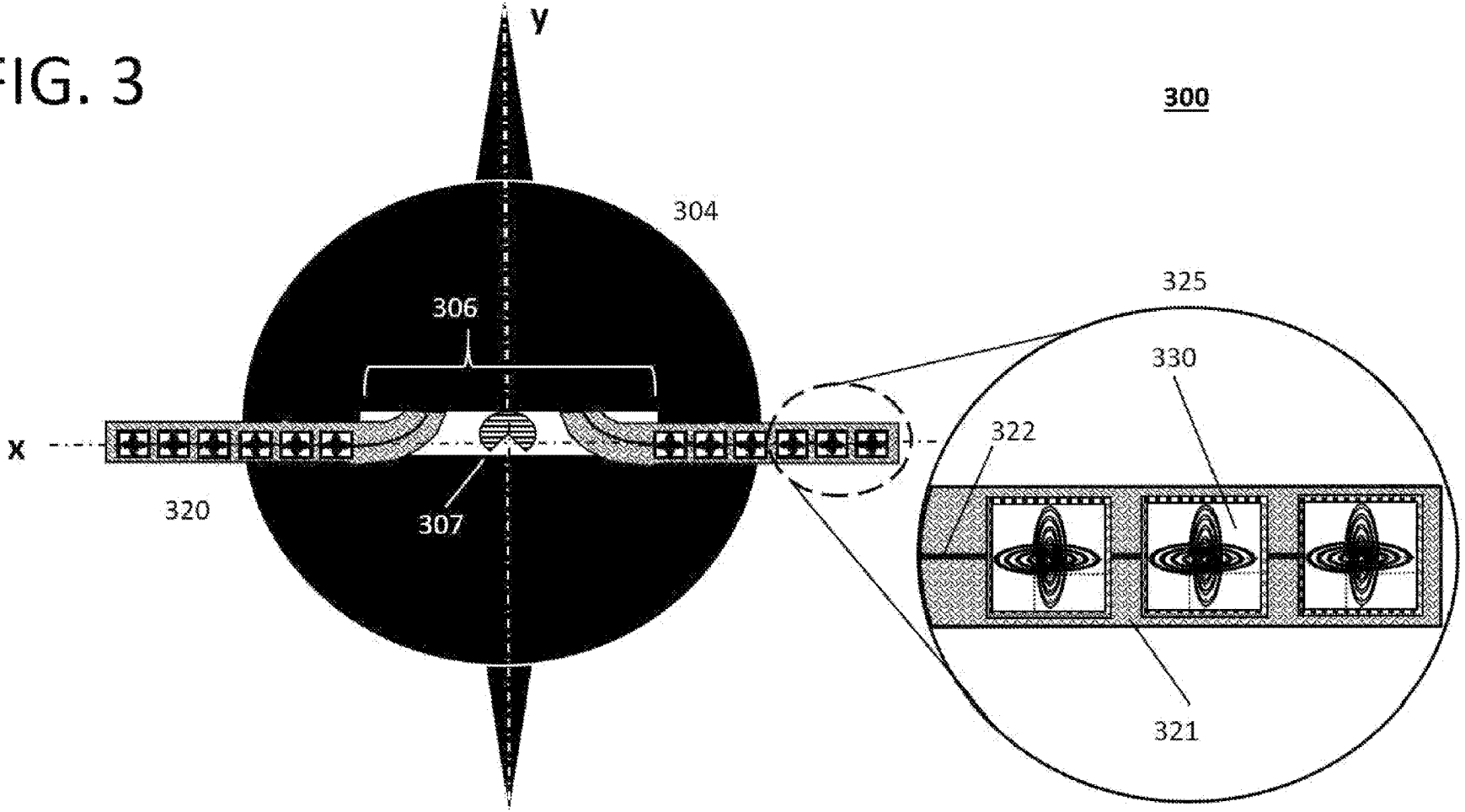
FIG. 3 is an illustration of a sensing whisker configuration according to example embodiments.

FIG. 3 is an illustration 300 of a sensing whisker configuration according to example embodiments. Illustration 300 provides an expanded view of the y-x plane view 200*c* in FIG. 2. In other words, a front view of UUV 304.

Illustration 300 shows a larger depiction of sensing whisker configuration 320. The sensing whisker configuration 320 may comprise two individual sensing whiskers protruding from a sensing whisker base 306. A length defines a gap between the two sensing whiskers in the sensing whisker configuration 320. Each sensing whisker may have a sensor arrangement 325. Within the gap of the sensing whisker base 306 may reside a UUV grappler 307. The UUV grappler 307 may be used to grab a metallic object. The relationship between the sensing whisker configuration 320 and the UUV grappler 307 is discussed further in FIG. 7.

Focusing on the sensor arrangement 325, each sensing whisker may be made up of a nonferrous support 321. Placed throughout the nonferrous support 321 may be a plurality of sensor units 330. Nonferrous support 321 may include a row of sensor units 330 along the face of a sensing whisker. In alternative embodiments, the sensor units 330 may be situated on multiple faces of the sensing whisker, and/or distributed in multiple columns in a single face of the sensing whisker.

A row of sensor units 330 may be electronically connected through a sensor supply line 322. The sensor supply line 322 may provide power (e.g., electricity) to each sensor unit 330. The sensor supply line 322 may also provide sensed data from each sensor unit 330 to an operation component.

As previously mentioned, detecting, tracking, and locating electrically conductive and/or magnetically permeable metallic objects in underwater environments may present operational difficulties for UUVs. Sensing whisker configuration 320 may provide a simple, reliable, accurate, and energy efficient method to search, detect, track, and locate any kind of metallic, electrically conductive, and/or magnetically permeable object(s) underwater. Sensing whisker configuration 320 may accomplish this through a combination of electromagnetic transducers/sensors and magnetic sensors at each sensor unit 330. The plurality of sensor units 330 may be configured to interact with an operational component comprising electronic circuits and control algorithms. This may facilitate a locating and/or self-positioning operation by a maneuvering UUV.

Figure 4:
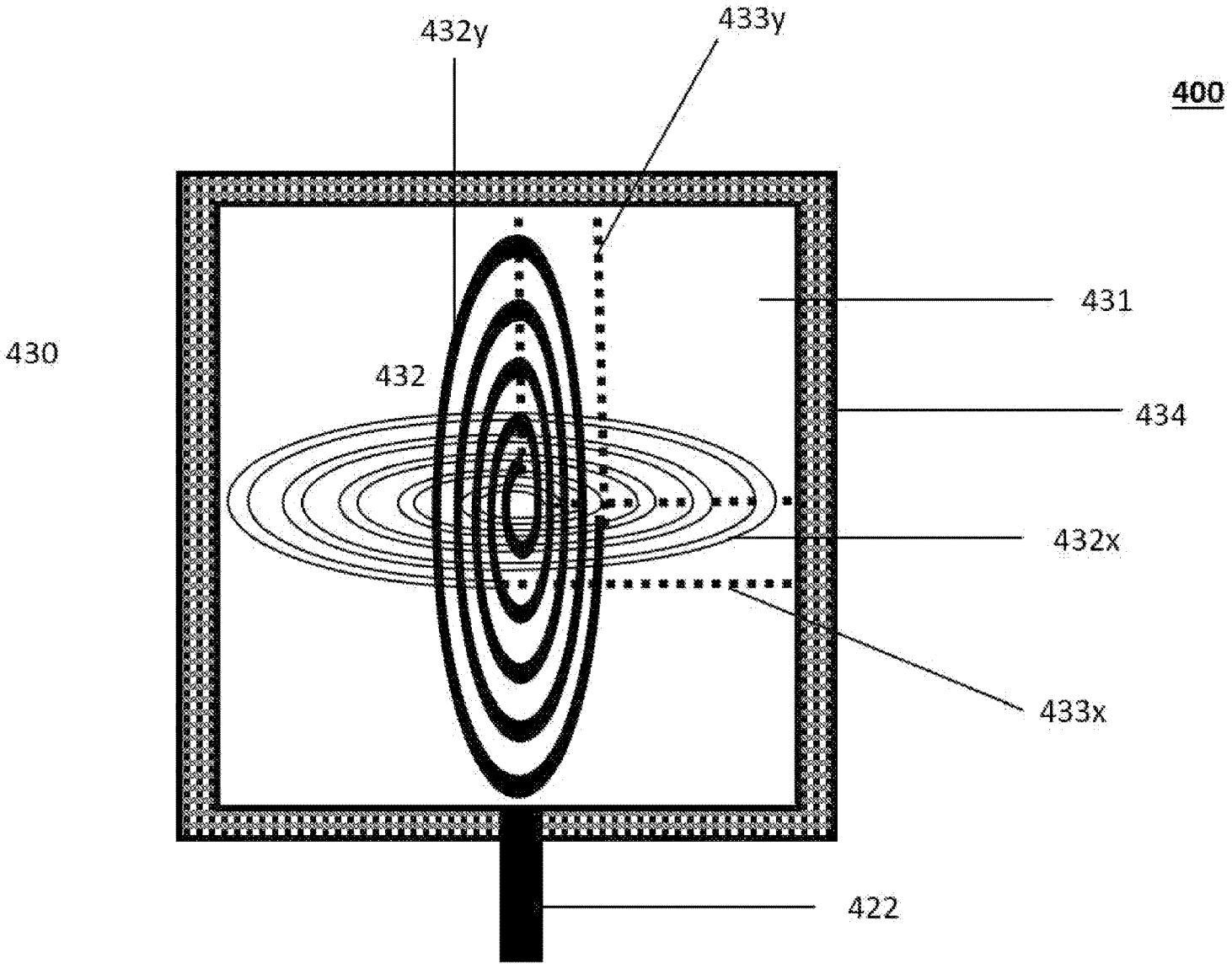
FIG. 4 is an illustration of a single sensor unit of a sensing whisker according to example embodiments.

FIG. 4 is an illustration 400 of a single sensor unit of a sensing whisker according to example embodiments. The sensor unit 430 may comprise a sensor base 434 to attach the sensor unit 430 to a nonferrous support. The sensor base 434 may also support a coil bed 431. Resting on the coil bed 431 may be an X-Y coil arrangement 432. In alternative example embodiments, the X-Y coil arrangement 432 may reside directly on the nonferrous support.

The X-Y coil arrangement 432 provides a configuration of two orthogonal coils. The first coil may be an electric (E)

field coil 432$x$, which may be configured along an x-axis of the coil bed 431. A second coil may be a magnetic (H) field coil 432$y$, which may be configured along a y-axis of the coil bed 431. In alternative example embodiments, the electric (E) field coil may be in the y-axis, and the magnetic (H) field coil may be in the x-axis.

Each coil in the X-Y coil arrangement 432 may be connected with a dedicated supply line. More specifically, electric (E) field coil 432$x$ may be connected to an electric (E) field coil supply line 433$x$. Likewise, magnetic (H) field coil 432$y$ may be connected to a magnetic (H) field coil supply line 433$y$. Each of the electric (E) field coil supply line 433$x$ and the magnetic (H) field coil supply line 433$y$ may be connected to a sensor supply line 422. The sensor supply line 422 may provide the entire sensor unit 430 with necessary power (e.g., electricity) for operation of the coil X-Y arrangement 432. The sensor supply line 422 may also facilitate a connection with operational components. The operational components may comprise electronic circuits and control algorithms.

Use of a plurality of sensor units 430 in sensing whiskers of a UUV may provide sufficient controllability of sensing intensity, accuracy, and energy requirements. These increased controllability characteristics may also be associated with the location of a metallic object being tracked. Unlike a permanent magnet, strength of an electromagnetic field may be controlled by simply changing the power (e.g., electricity) provided to the plurality of sensor units 430 (individually, in tandem, or a combination thereof). This may be realized by adjusting an amount of electric current that flows through the sensor supply lines 422 and/or the current that is provided to each sensor unit 430.

Figure 5:
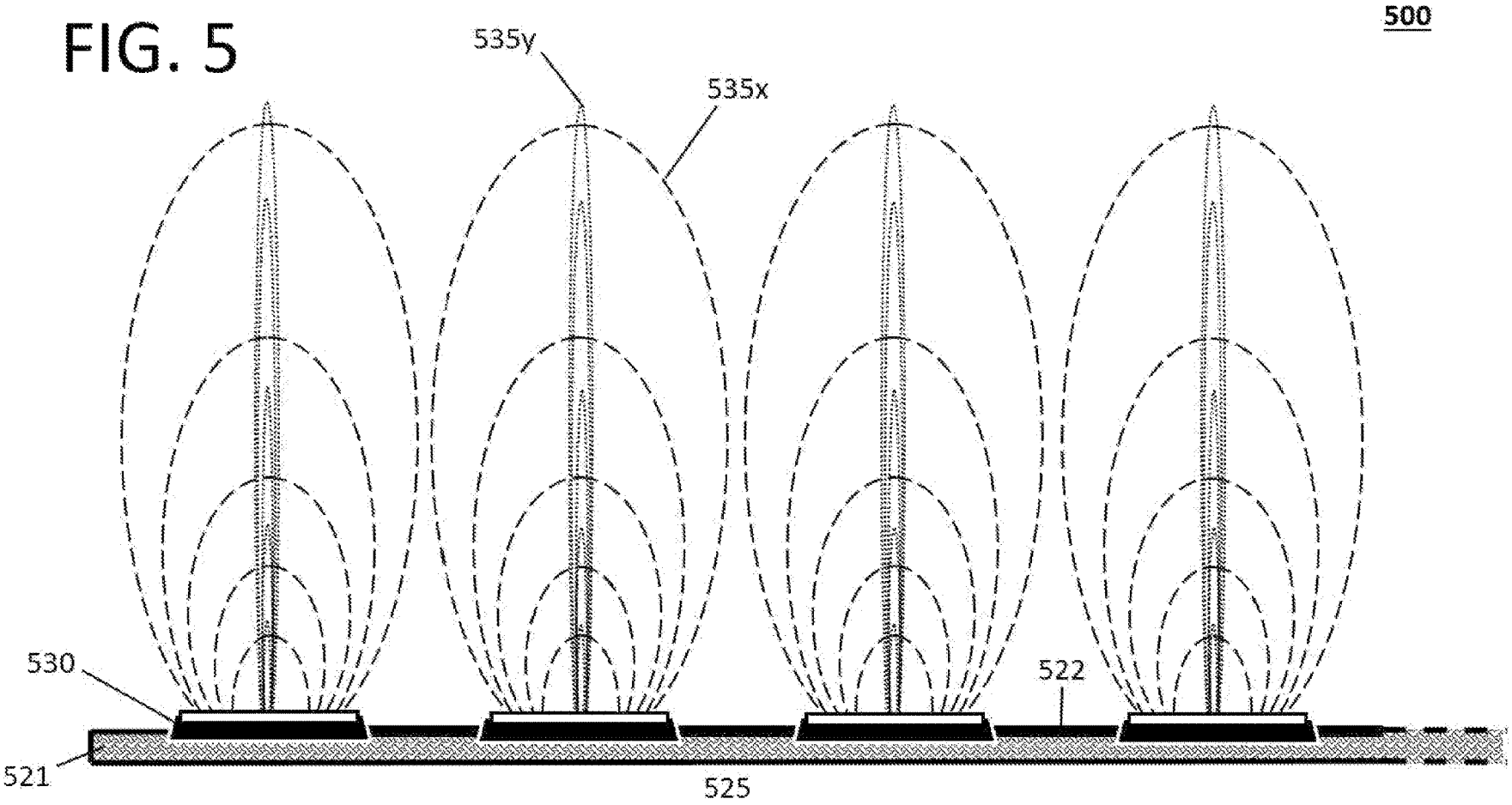
FIG. 5 is an illustration of electromagnetic fields of a single sensing whisker according to example embodiments.

FIG. 5 is an illustration 500 of electromagnetic fields of a single sensing whisker according to example embodiments. A sensing whisker sensor arrangement 525 may comprise a plurality of sensor units 530 distributed along the length of the sensing whisker. The sensor units 530 may be connected to a sensor supply line 522. The sensor units 530 may all rest on a nonferrous support 521.

Illustration 500 depicts two forms of sensing electromagnetic flux lines, which are orthogonal to each other. A first is magnetic (H) field 535$x$, which may be generated by a magnetic (H) field coil of an individual sensor unit 530. The second is an electric (E) field 535$y$, which may be generated by an electric (E) field coil of an individual sensor unit 530. As the magnetic (H) field coil and the electric (E) field coil of each of sensor unit 530 are configured to be orthogonal to each other, the field generated by each is also orthogonal to each other. This also conforms to the characteristics of an electromagnetic wave.

The poles of the generated fields may be reversed by reversing the flow of the electrical current to the sensor units 530. The configuration of the sensor unit 530 may operate in this fashion because an electric current produces a magnetic field by Faraday's law. The amplitude and frequency of an electromagnetic wave can be controlled by power electronic (s), micro-processor(s), and/or software algorithm(s) with feedback system(s) to optimize electromagnetic wave requirements for accuracy. Such calibration permits location detection of a metallic object.

Figure 6:
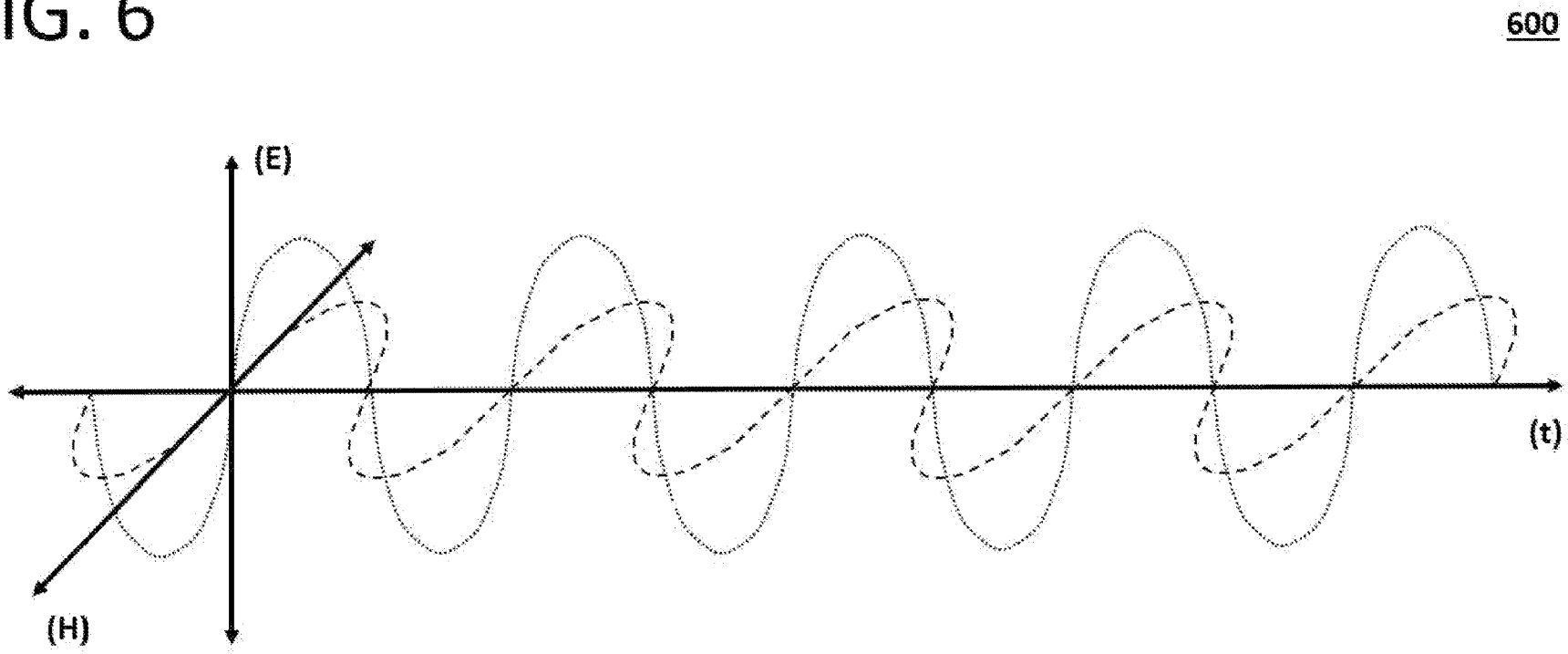
FIG. 6 is an electromagnetic propagation wave used by a single sensor unit according to example embodiments.

FIG. 6 is an electromagnetic propagation wave 600 used by a single sensor unit according to example embodiments. As depicted, an electric field (E) wave is orthogonal to a magnetic field (H) wave over a period of time (t). A configuration of a sensor unit in a sensing whisker permits the generation of a field that can interact with metal objects in a marine environment. In particular, orthogonal coils in a single unit facilitate the generation of a collective electromagnetic field. A current and/or voltage of electricity traversing the orthogonal coils may alter a magnitude of a generated field.

Figure 7:
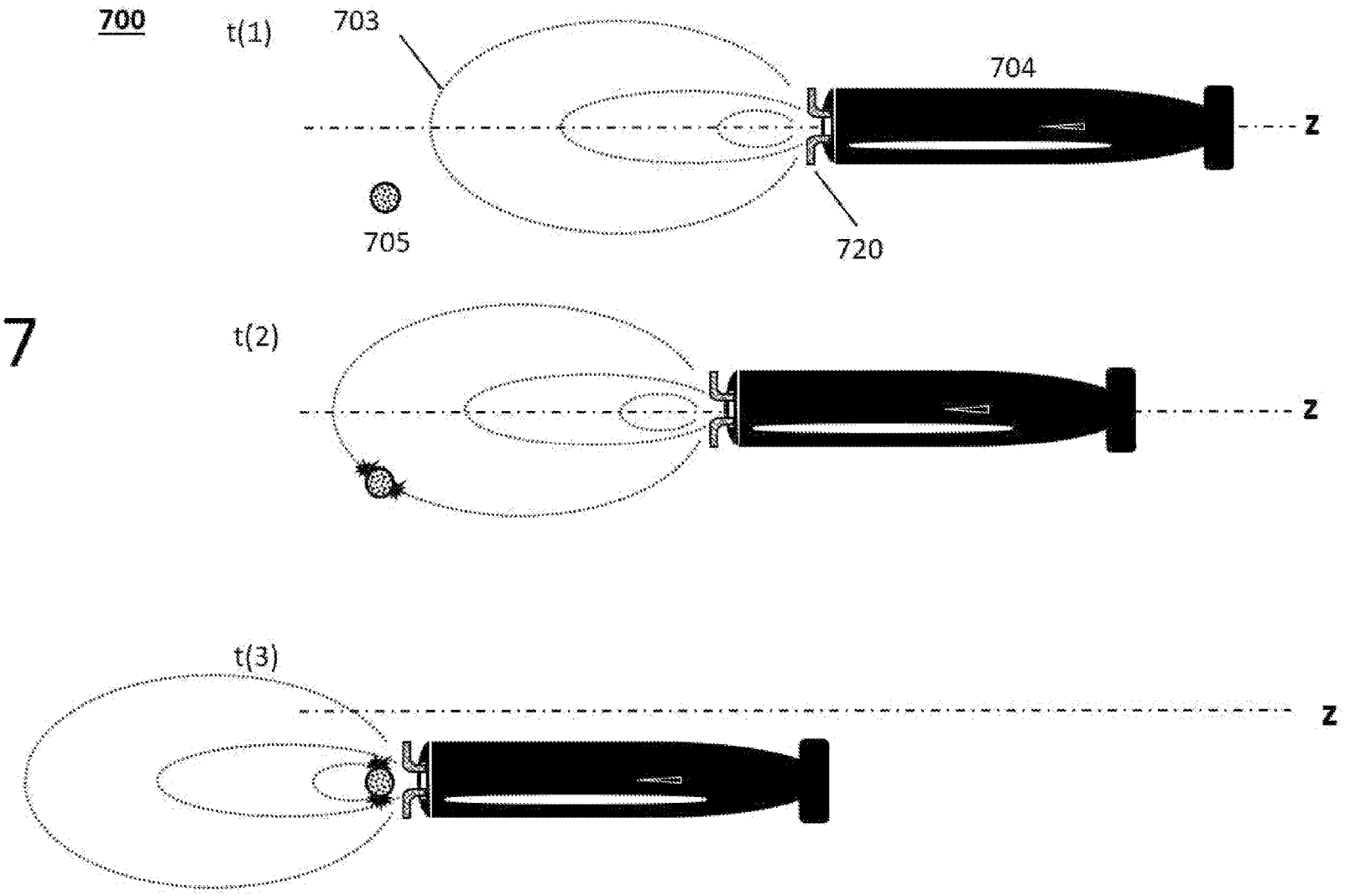
FIG. 7 is a time-based operation in a single plane of a UUV with sensing whiskers according to example embodiments.

FIG. 7 is a time-based operation 700 in a single plane of a UUV with sensing whiskers according to example embodiments. Operation 700 depicts a UUV 704 moving along a z-axis at three time intervals. At a first time interval t (1), the UUV 704 may be in a rest position, or at an initiation position. In some example embodiments, interval t (1) may correspond to the initiation of a homing and docking of the UUV 704. At t (1), power (e.g., electricity) may be provided to the sensing units of a sensing whisker configuration 720 to generate an electromagnetic field. The electromagnetic field is illustrated by sensing electromagnetic flux lines 703. The power provided to the sensing whisker configuration 720 may be initially activated and/or adjusted in anticipation of locating metal line 705.

At a second time interval t (2), the UUV 704 may have moved further along the a z-axis. At this point, the electromagnetic field is altered by the presence of a metal line 705, as reflected by the intersection of the sensing electromagnetic flux lines 703 with the metal line 705. As the UUV 704 moves closer to the metal line 705, the electromagnetic field continues to be impacted more substantially so as to permit a more precise calculation of the position of the metal line 705 using the sensing whisker configuration 720. Based on electromagnetic strength sensed by the sensing whisker configuration 720, an appropriate bearing of the UUV 704 may be calculated by the operational components of the UUV 704.

At a third time interval t (3), the metal line 705 has entered a relative proximity to the sensing whisker configuration 720. The interaction of the metal line 705 with the electromagnetic field, as depicted by the sensing electromagnetic flux lines 703, allows the UUV 704 to center itself relative to the location of the metal line 705. Eventually, the UUV 704 may initiate a grabbing operation using a UUV grappler at a sensing whisker base. In some example embodiments, the sensing whisker configuration 720, in conjunction with operational components, may know when the metal line 705 is captured by the UUV grappler.

Figure 8:
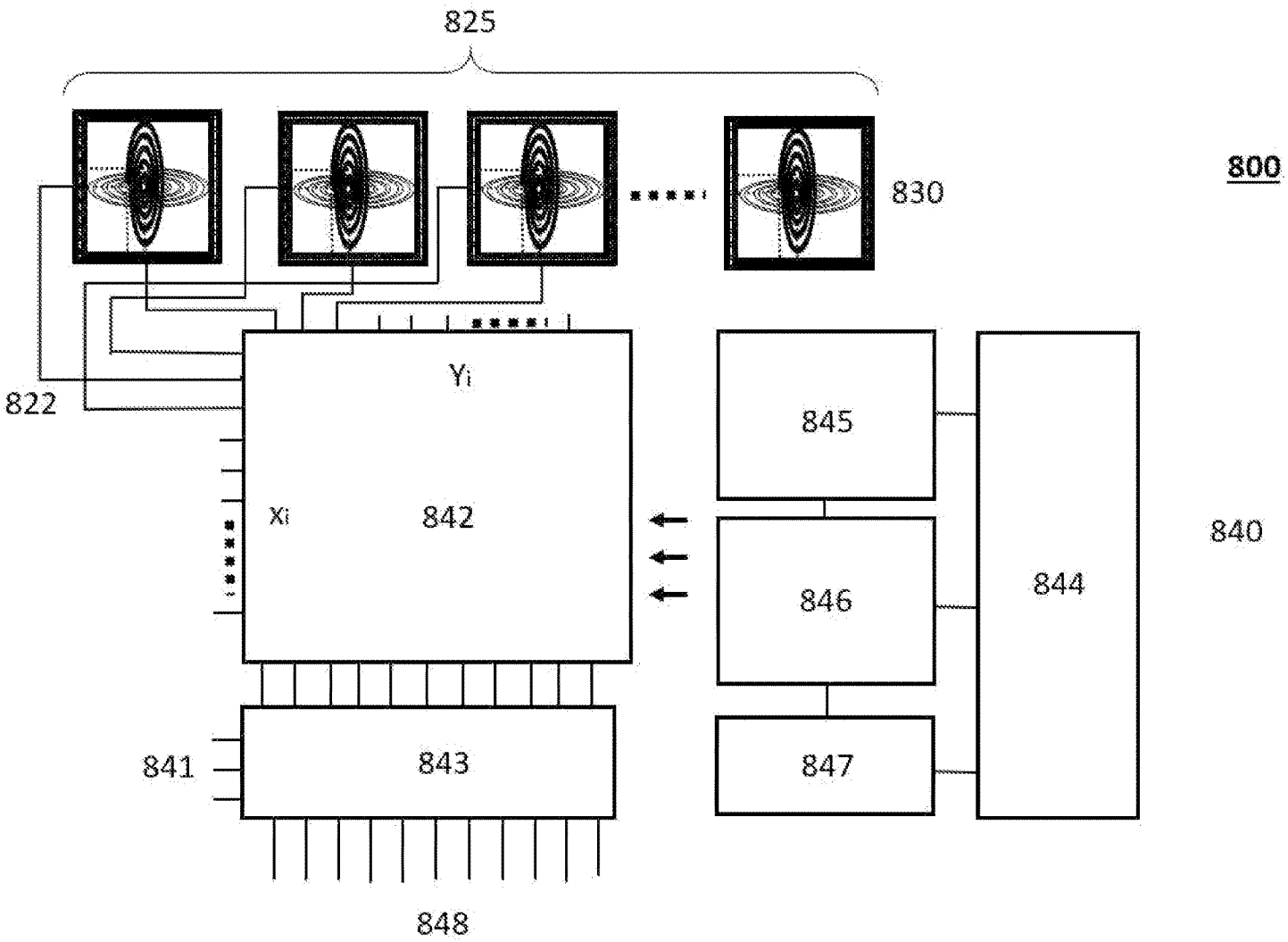
FIG. 8 is an illustration of operational components of sensing whiskers according to example embodiments.

FIG. 8 is an illustration 800 of operational components of sensing whiskers according to example embodiments. Illustration 800 shows a configuration of a sensing whiskers sensor arrangement 825 and operational components 840.

With respect to the sensing whiskers sensor arrangement 825, a plurality of sensor units 830 are each connected to sensor supply line 822. The sensor supply line 822 may be a single line or separate lines for each coil (X and Y) of an individual sensor unit 830. The sensor supply line 822 may be a plurality of lines for each axis, such that if there is a number i of sensor units 830, then there is a number $X_i$ and $Y_i$ of lines constituting the sensor supply line 822. In alternative example embodiments, sensor supply line 822 may be one or two lines that accommodate communications by all of the sensor units 830.

The sensor supply line 822 may be connected to the operational components 840. More specifically, the constituent parts of the sensor supply line 822 may be connected to a control circuit 842. The control circuit 842 may generate the necessary control signals, power, voltage, and/or current to the plurality of sensor units 830. The control circuit 842 may be connected to a microprocessor 843.

The microprocessor 843 may extrapolate information about a sensed metal line based on electromagnetic fluctuations. The microprocessor 843 may include output lines 848 and input lines 841. This permits the operational components 840 to provide feedback and/or receive instructions. The feedback and/or instructions may be from a human operator, computer programming, or artificial intelligence. The feedback and/or instructions may emanate from the UUV, another vehicle (surface and/or underwater), another UUV, or from a remote location (e.g., satellite).

The operational components 840 also may also include additional circuitry, such as a DC power source 844, a DC/AC converter 845, a power modulator 846, and/or a frequency generator 847. These elements may allow functioning of the operational components 840.

Figure 9:
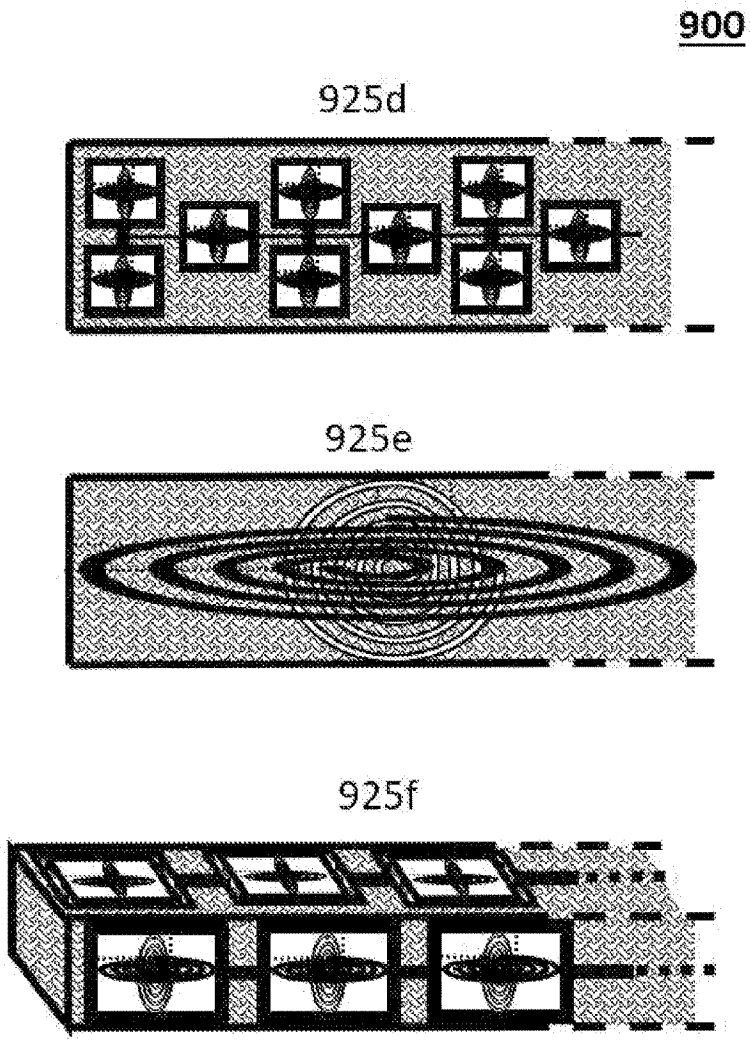
FIG. 9 is an illustration of various sensing whisker sensor arrangements according to example embodiments.
Figure 9:
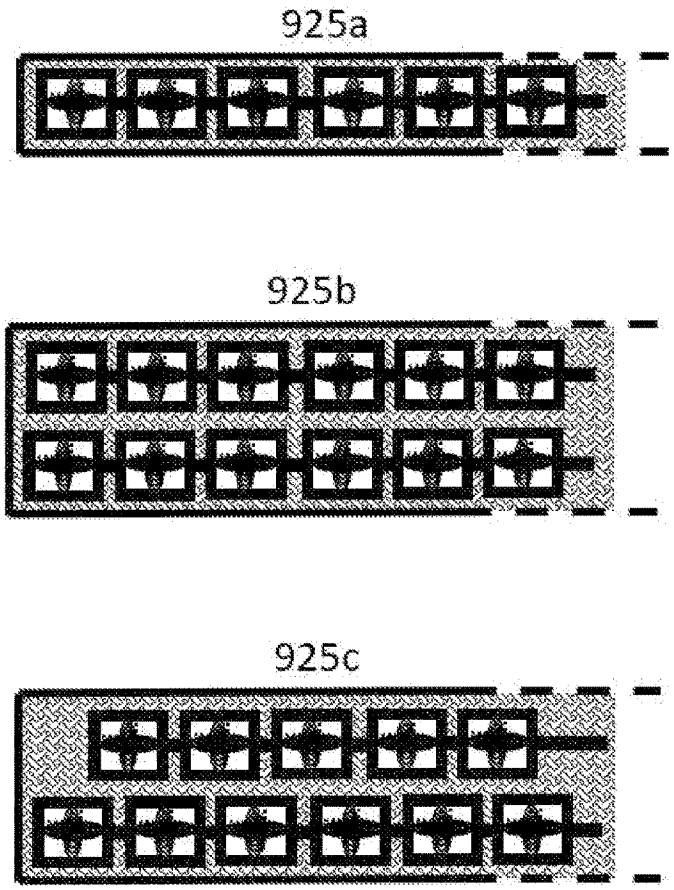

FIG. 9 is an illustration 900 of various sensing whisker sensor arrangements according to example embodiments. A first example embodiment 925*a* of a sensing whisker sensor arrangements is consistent with previously discussed examples. More specifically, the first example embodiment 925*a* provides a single row of a plurality of sensing units distributed across a sensing whisker.

Other examples can provide multiple rows of sensing units. More specifically, a second example embodiment 925*b* provides two rows of a plurality of sensing units distributed across a sensing whisker. A third example embodiment 925*c* also provides two rows, but the rows are offset relative to each other. In a fourth example embodiment 925*d*, a set of two sensing units in a column alternates with a single sensing unit throughout the length of a sensing whisker.

Other example embodiments may lean on simplification. A fifth example embodiment of a sensing whisker sensor arrangement has a single coil arrangement pair in a continuous loop wire distributed through an entire sensing whisker. This single coil may be paired with an orthogonal coil as well.

Finally, alternative example embodiments may try to increase an electromagnetic field by taking advantage of multiple faces in a sensing whisker. A sixth example embodiment 925*f* provides a single row of a plurality of sensing units across two faces of a sensing whisker.

Figure 10:
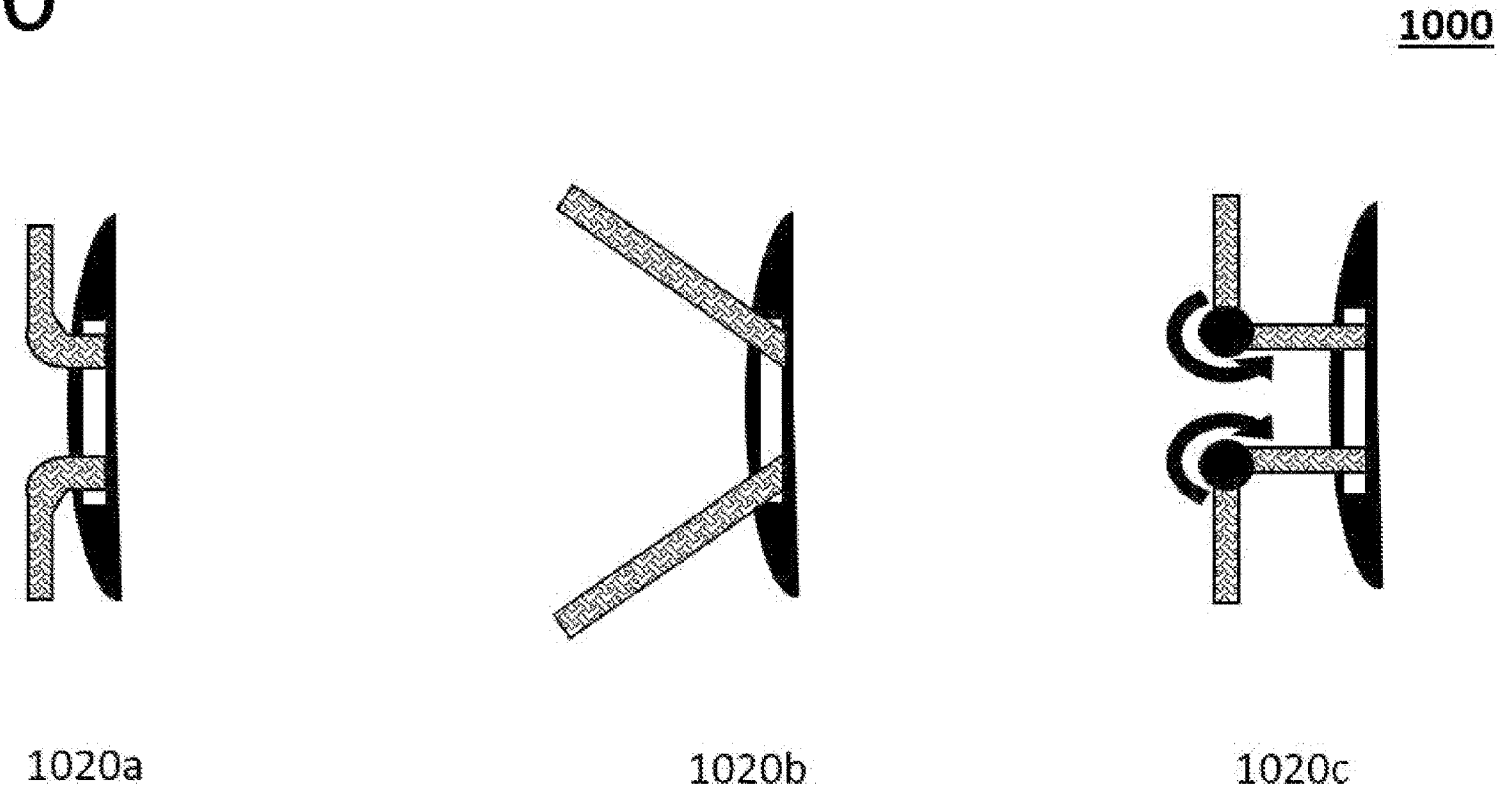
FIG. 10 is an illustration of various sensing whisker configurations according to example embodiments.

FIG. 10 is an illustration 1000 of various sensing whisker configurations according to example embodiments. A first example embodiment 1020*a* of a sensing whisker configuration is consistent with previously discussed examples. More specifically, the first example embodiment 1020*a* provides two sensing whiskers that bend in a 90 degree or a near 90 degree angle. This configuration permits capture of a metal line.

Other example embodiments that permit operation of a sensing whisker configuration may be deployed. A second example embodiment 1020*b* may comprise two straight sensing whiskers that emanate at an angle from a sensing whisker base.

A third example embodiment 1020*c* may comprise sensing whiskers with a joint at a midpoint or other segment of a whisker. In this example embodiment, the sensing whiskers may be moved about the joint whenever appropriate. The third example embodiment 1020*c* may permit fine directional movements of an electromagnetic field. This example embodiment may also permit the sensing whisker configuration to assist a UUV grappler when attempting to connect to a metal line. It may accomplish this by closing on the metal line via the joints once it is within a defined proximate distance from a sensing whisker base.

Figure 11:
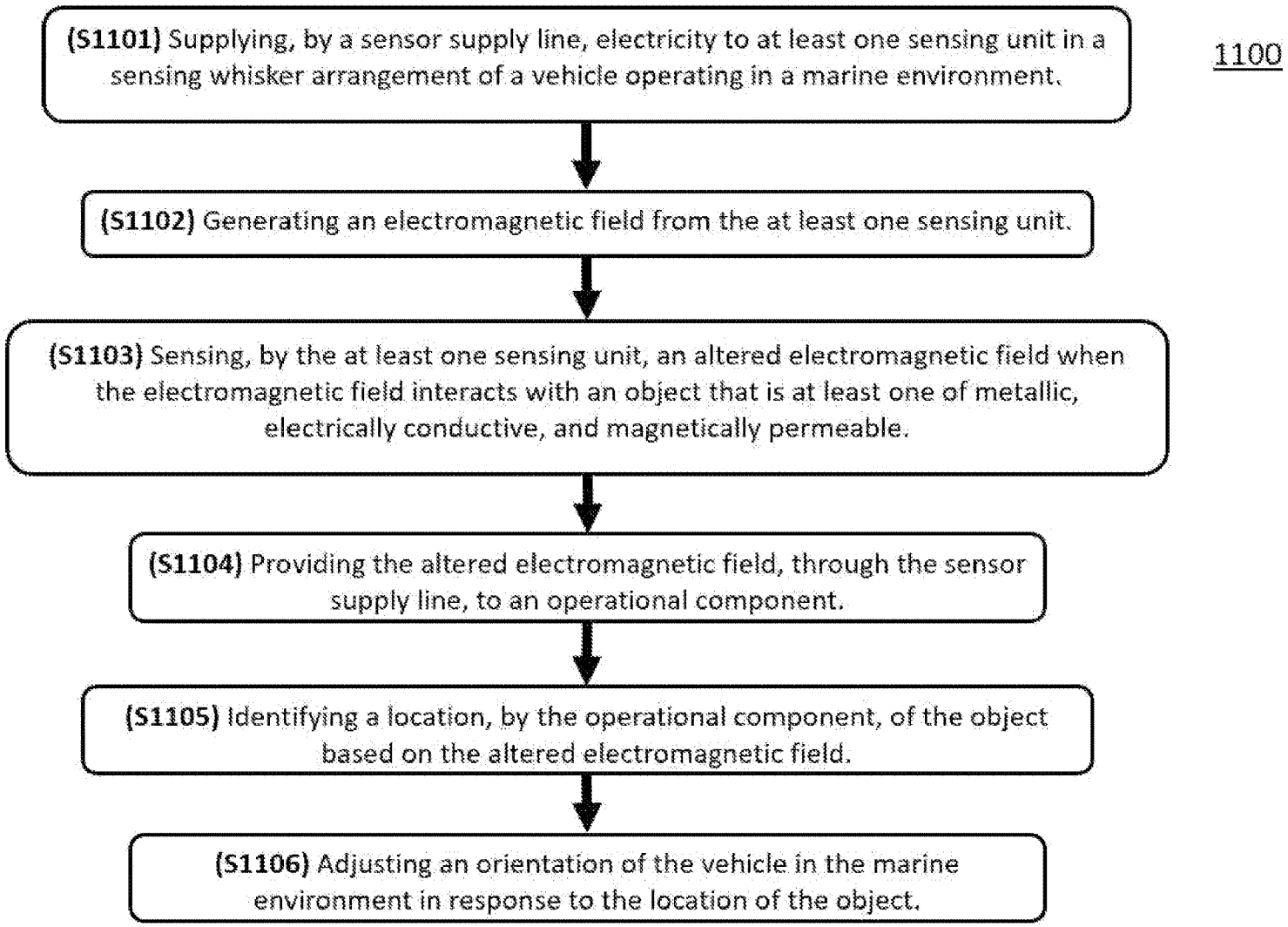
FIG. 11 is a flowchart operating method of a UUV with sensing whiskers according to example embodiments.

Finally, FIG. 11 is a flowchart operating method 1100 of a UUV with sensing whiskers according to example embodiments. At a step (S1101) a sensor supply line may supply electricity to at least one sensing unit in a sensing whisker arrangement of a vehicle operating in a marine environment. Next, (S1102) an electromagnetic field may be generated by the at least one sensing unit. Step (S1103) is sensing, by the at least one sensing unit, an altered electromagnetic field when the electromagnetic field interacts with an object that is at least one of metallic, electrically conductive, and magnetically permeable. The object may be a line from a marine vehicle. At step (S1104), the sensor supply line may provide the altered electromagnetic field to an operational component. Next is (S1105), identifying a location, by the operational component, of the object based on the altered electromagnetic field. Finally, an orientation of the vehicle may be (S1106) adjusted while in the marine environment in response to the location of the object.

The example embodiments being thus described, it will be obvious that the same may be varied in many ways. Such variations are not to be regarded as a departure from the disclosed subject matter, and all such modifications are intended to be included within the scope of the disclosed subject matter.

What is claimed is:

1. A sensing whisker apparatus comprising:

at least one sensing unit configured to generate an electromagnetic field and to sense alterations to the electromagnetic field;

a nonferrous support providing a surface along at least an axis and configured to support the at least one sensing unit;

a sensor supply line traversing the nonferrous support and configured to provide electricity to each of the at least one sensing unit; and an operational component configured to at least control the electricity provided through the sensor supply line and to receive sensed alterations to the electromagnetic field, wherein each of the at least one sensing units comprises a coil arrangement, the coil arrangement comprising a first coil and a second coil, the first coil and the second coil being orthogonal to each other and in a same plane of the surface of the nonferrous support, wherein the sensing whisker apparatus is configured to extend from a base opening at a bow of a vehicle.

2. The sensing whisker apparatus of claim 1, wherein the first coil is an electric field coil along a first axis and configured to generate an electric field, wherein an electric field coil supply line provides the electric field coil with electricity for generating the electric field, wherein the second coil is a magnetic field coil along a second axis and configured to generate a magnetic field, wherein a magnetic field coil supply line provides the magnetic field coil with electricity for generating the magnetic field, and wherein the electric field coil supply line and the magnetic field coil supply line are configured to receive electricity from the sensor supply line.

3. The sensing whisker apparatus of claim 2, wherein the first axis is an x-axis, and the second axis is a y-axis, the x-axis and the y-axis being orthogonal to each other.

4. The sensing whisker apparatus of claim 2, wherein the at least one sensing unit is arranged in a row along the length of the nonferrous support.

5. The sensing whisker apparatus of claim 1, wherein the electromagnetic field generated by the at least one sensing unit is altered when it interacts with an object that is at least one of metallic, electrically conductive, and magnetically permeable, wherein an altered electromagnetic field is sensed by the at least one sensing unit and provided to an operational component, and wherein the operational component is configured to identify at least the location of the object based on the altered magnetic field.

6. The sensing whisker apparatus of claim 5, the operational component comprising, a control circuit connected to the sensor supply line and configured to provide the electricity through the sensor supply line a microprocessor connected to the control circuit and configured to control an amount of electricity provided by the control circuit, and configured to extrapolate information based on the sensed alterations to the electromagnetic field, input lines connected to the microprocessor to provide instructions to the microprocessor, and output lines connected to the microprocessor to provide feedback from the microprocessor based on at least the extrapolated information.

7. The sensing whisker apparatus of claim 5, the operation component comprising at least one of a DC power source, a DC/AC converter, a power modulator, and a frequency generator.

8. A sensing system comprising:

a vehicle configured to traverse a marine environment;

a base opening at a bow of the vehicle;

a sensing whisker configuration situated at the base opening, the sensing whisker configuration comprising at least two sensing whiskers, each sensing whisker comprising, at least one sensing unit configured to generate an electromagnetic field and to sense alterations to the electromagnetic field;

a nonferrous support providing a surface along at least an axis and configured to support the at least one sensing unit;

a sensor supply line traversing the nonferrous support and configured to provide electricity to each of the at least one sensing unit, and an operational component configured to at least control the electricity provided through the sensor supply line and to receive sensed alterations to the electromagnetic field wherein each of the at least one sensing unit comprises a coil arrangement, the coil arrangement comprising a first coil and a second coil, the first coil and the second coil being orthogonal to each other and in a same plane of the surface of the nonferrous support.

9. The sensing whisker apparatus of claim 8, wherein the electromagnetic field generated by the at least one sensing unit is altered when it interacts with an object that is at least one of metallic, electrically conductive, and magnetically permeable, wherein an altered electromagnetic field is sensed by the at least one sensing unit and provided to an operational component, and wherein the operational component is configured to identify at least the location of the object based on the altered magnetic field.

10. The sensing whisker apparatus of claim 9, the operational component comprising, a control circuit connected to sensor supply line and configured to provide the electricity through the sensor supply line, a microprocessor connected to the control circuit and configured to control an amount of electricity provided by the control circuit, and configured to extrapolate information based on the sensed alterations to the electromagnetic field, input lines connected to the microprocessor to provide instructions to the microprocessor, and output lines connected to the microprocessor to provide feedback from the microprocessor based on at least the extrapolated information.

11. The sensing whisker apparatus of claim 10, the operation component comprising at least one of a DC power source, a DC/AC converter, a power modulator, and a frequency generator.

12. The sensing whisker apparatus of claim 8, wherein the vehicle is configured to adjust an orientation in response to the sensed alterations to the electromagnetic field.

13. The sensing whisker apparatus of claim 12, wherein the sensed alterations to the electromagnetic field correspond to an object that is at least one of metallic, electrically conductive, and magnetically permeable, wherein the operational component is further configured to determine a location of the object based on the sensed alterations to the electromagnetic field, and wherein the orientation of the vehicle is adjusted based on the location of the object.

14. The sensing whisker apparatus of claim 13, further comprising:

a grappler housed within the base opening of the vehicle, wherein the vehicle is configured to adjust the orientation in order to center the object relative to the base opening and permit the grappler to grab the object.

15. A sensing method comprising:

supplying, by a sensor supply line, electricity to at least one sensing unit in a sensing whisker arrangement of a vehicle operating in a marine environment;

generating an electromagnetic field from the at least one sensing unit;

sensing, by the at least one sensing unit, an altered electromagnetic field when the electromagnetic field interacts with an object that is at least one of metallic, electrically conductive, and magnetically permeable;

providing the altered electromagnetic field, through the sensor supply line, to an operational component;

identifying a location, by the operational component, of the object based on the altered electromagnetic field; and adjusting an orientation of the vehicle in the marine environment in response to the location of the object wherein each of the at least one sensing unit comprises a coil arrangement, the coil arrangement comprising a first coil and a second coil, the first coil and the second coil being orthogonal to each other and in a same plane of the surface of the at least one sensing unit, wherein the sensing whisker apparatus is configured to extend from a base opening at a bow of the vehicle.

* * * * *